US010562153B2

(12) United States Patent
Schoch et al.

(10) Patent No.: US 10,562,153 B2
(45) Date of Patent: Feb. 18, 2020

(54) COATED GRINDING MEANS

(71) Applicant: SIA Abrasives Industries AG, Frauenfeld (CH)

(72) Inventors: Adrian Schoch, Warth (CH); Bruno Oberhaensli, Frauenfeld (CH)

(73) Assignee: sia Abrasives Industries AG, Fraunfeld (CH)

( * ) Notice: Subject to any disclaimer, the term of this patent is extended or adjusted under 35 U.S.C. 154(b) by 307 days.

(21) Appl. No.: 15/376,820

(22) Filed: Dec. 13, 2016

(65) Prior Publication Data

US 2017/0087692 A1 Mar. 30, 2017

Related U.S. Application Data

(62) Division of application No. 14/234,917, filed as application No. PCT/EP2012/064376 on Jul. 23, 2012, now Pat. No. 9,555,520.

(30) Foreign Application Priority Data

Jul. 25, 2011 (EP) ..... 11175222

(51) Int. Cl.

| | |
|---|---|
| ***B24D 3/00*** | (2006.01) |
| ***B24D 3/34*** | (2006.01) |
| ***B24D 11/00*** | (2006.01) |

(52) U.S. Cl.

CPC ..... *B24D 3/004* (2013.01); *B24D 3/00* (2013.01); *B24D 3/34* (2013.01); *B24D 11/001* (2013.01); *B24D 11/005* (2013.01)

(58) Field of Classification Search

CPC . B24D 3/00; B24D 3/004; B24D 3/28; B24D 3/34; B24D 11/001; B24D 11/005

See application file for complete search history.

(56) References Cited

U.S. PATENT DOCUMENTS 5,454,750 A * 10/1995 Cosmano ..... B24D 3/34 451/526
5,498,268 A * 3/1996 Gagliardi ..... B24D 3/04 51/294

(Continued)

FOREIGN PATENT DOCUMENTS

CN 1266392 A 9/2000
CN 1284904 A 2/2001

(Continued)

OTHER PUBLICATIONS

International Search Report corresponding to PCT Application No. PCT/EP2012/064376, dated Nov. 9, 2012 (German and English language document) (5 pages).

*Primary Examiner* — Timothy V Eley
(74) *Attorney, Agent, or Firm* — Maginot, Moore & Beck LLP

(57) ABSTRACT

A method for producing a coated abrasive includes producing or providing an intermediate abrasive product that comprises a substrate, a plurality of abrasive grains that are bonded to the substrate, and at least one layer of an uncured size coat that at least partially covers the abrasive grains with the uppermost size coat being uncured. The method further includes applying at least one grinding additive to the uppermost, uncured size coat with the grinding additive applied to the size coat in dry form. The method also includes curing the uppermost size coat. A coated abrasive is produced by the method and the coated abrasive is used to process a surface.

13 Claims, 10 Drawing Sheets

(56) References Cited

U.S. PATENT DOCUMENTS

| | | | | |
|---|---|---|---|---|
| 5,552,225 | A * | 9/1996 | Ho | B24D 3/34 428/357 |
| 5,562,745 | A * | 10/1996 | Gagliardi | B24D 3/342 51/295 |
| 5,578,098 | A * | 11/1996 | Gagliardi | B24D 3/34 428/327 |
| 7,294,048 | B2 | 11/2007 | Nelson et al. | |
| 8,080,072 | B2 | 12/2011 | Woo et al. | |
| 8,399,597 | B2 * | 3/2013 | Pullichola | B24D 3/28 528/155 |
| 9,033,765 | B2 | 5/2015 | Woo et al. | |
| 2002/0026752 | A1 * | 3/2002 | Culler | B24D 3/28 51/298 |
| 2004/0029511 | A1 | 2/2004 | Kincaid et al. | |
| 2010/0011672 | A1 | 1/2010 | Kincaid et al. | |
| 2013/0337725 | A1 | 12/2013 | Monroe | |
| 2015/0004891 | A1 | 1/2015 | Seth et al. | |
| 2015/0126098 | A1 | 5/2015 | Eilers et al. | |

FOREIGN PATENT DOCUMENTS

| | | | |
|---|---|---|---|
| CN | 1795079 | A | 6/2006 |
| CN | 101668825 | A | 3/2010 |
| EP | 1 493 535 | A1 | 1/2005 |
| WO | 2008/079932 | A2 | 7/2008 |

* cited by examiner

COATED GRINDING MEANS

This application is a divisional application of co-pending application Ser. No. 14/234,917, which has a 35 U.S.C. § 371(c) date of Jan. 24, 2014 and is a 35 U.S.C. § 371 National Stage Application of PCT/EP2012/064376, filed on Jul. 23, 2012, which claims the benefit of priority to Serial No. EP 11175222.6, filed on Jul. 25, 2011 in the European Patent Office, the disclosures of which are incorporated herein by reference in their entirety.

BACKGROUND

The present disclosure relates to a method for producing a coated abrasive, to a coated abrasive, and to the use of a coated abrasive.

Flexible abrasives such as, for example, abrasive belts or fibre discs can be used to work a multiplicity of surfaces. Some surfaces, such as those of stainless steel, for example, require the abrasive to be additionally coated with what are called grinding aids. Grinding aids employed are typically salts, comprising primarily the elements boron and/or fluorine. Typical representatives are potassium tetrafluoroborate ($KBF_4$) and cryolite ($Na_3AlF_6$=aluminium trisodium hexafluoride). An additional coating of this kind may have the effect, for example, of prolonging the lifetime of an abrasive and hence also the total abraded amount by a multiple.

In the production of these conventionally coated abrasives, the additional coating is applied in the form of a liquid mixture, which in addition to the actual grinding aid may further comprise a binding agent, a solvent (such as water, for example) and optionally colours, rheological additives, wetting agents, defoamers or fillers. This liquid mixture is applied to an intermediate abrasive product, which comprises a backing, a multiplicity of abrasive grains, and also at least one first, cured size coat. The additional coating applied in liquid form is subsequently cured, by heating for example, to give a second layer of size coat.

Alternatively the additional coating may also be applied to an intermediate abrasive product which comprises only a backing, a make coat and abrasive grains, but no size coat. In that case the cured additional coating forms the sole size coat.

This production method, however, is decidedly costly and inconvenient, since it is necessary first of all to prepare a suspension comprising the grinding aid and to cure this suspension again following its application. Furthermore, the liquid additional coating is applied typically by means of a roll process. A disadvantage of roll application is that the grinding aid accumulates in the valleys between the individual abrasive grains, while the peaks of the abrasive grains are covered with only a little grinding aid, this being detrimental to the service life and the abrasive performance. Generally speaking, an abrasive reaches the end of its service life as early as when the abrasive grains have worn down only to about 40% of the initial height. Particles of the grinding aid which are located below this level do not come into contact with the worked surface. This portion of the grinding aid is therefore totally unable to fulfil its purpose, and this is extremely uneconomic.

SUMMARY

It is therefore an object of the present disclosure to overcome the disadvantages in the prior art, and more particularly to provide a method for producing a coated abrasive that is economic and easy to implement and which guarantees very highly effective distribution of the grinding aid in those regions of the abrasive that actually enter into contact with the surface to be worked.

This object is achieved first by a method for producing a coated abrasive that comprises the following steps:

a) producing or providing an intermediate abrasive product, comprising a backing, a multiplicity of abrasive grains, which are bonded to the backing, and also at least one layer of an uncured size coat, which at least partly covers the abrasive grains, the uppermost size coat being uncured;

b) applying at least one grinding aid to the uppermost, uncured size coat; and c) curing the uppermost size coat.

In accordance with the disclosure, the grinding aid is applied in dry form in step b), more particularly by scattering.

The intermediate abrasive product may comprise one or more layers of a size coat. In the case of two layers of size coat, the lower size coat is typically referred to as "size coat 1" or "size coat", and the upper size coat as "size coat 2" or "supersize coat". For the disclosure it is essential that the uppermost size coat is uncured, i.e. the size coat that forms the outermost layer and is remote from the backing of the intermediate abrasive product.

The dry-applied grinding aid does not penetrate into lower layers of the size coat, but instead remains in a concentrated amount at the size coat surface. Moreover, the grinding aid undergoes distribution relatively parallel to the surface of the abrasive and hence in a much more homogeneous way. It therefore accumulates less in the regions between the individual abrasive grains. Accordingly, a larger fraction of the applied grinding aid is able to make contact with a surface to be worked than is the case for the hitherto customary liquid application. Consequently, in the case of the dry application according to the disclosure, in the majority of working examples, there is less grinding aid required per unit area than is required in order to obtain the same total abrasion amount with a conventional liquid coating. If the same application rate of the grinding aid as with conventional liquid coating is used, then the result is a higher total abrasion amount. Conversely, it is also possible to reduce the application rate of the abrasive grains in comparison to conventional abrasives; the reduction in total abrasion amount that results from this can be compensated by the dry application of the grinding aid, in accordance with the disclosure. The production method of the disclosure is hence much more economic. Since only comparatively little grinding aid is present between the abrasive grains, moreover, there remains more working space into which abraded material produced during grinding can be accommodated; this as well leads to an increase in the service life.

As has likewise been found, a dry-applied grinding aid can also be bonded firmly to the size coat solely by curing of the size coat. In this case, the grinding aid is fixed by the as yet uncured size coat, since this coat is able to migrate, by means of capillary forces, into the dry grinding aid. This type of production also does away with the need first to prepare a liquid additional coating and then to cure it again by means of an additional operating step.

It has been found, furthermore, that at least in the case of abrasives with a single layer of size coat, a dry-applied grinding aid results in far better fixing of the abrasive grains than is the case with wet-applied grinding aid. The abrasive grains therefore break out less easily when a surface is being worked. This effect is particularly pronounced at high grinding aid application rates. In the case of the conventional wet application, the grinding aid is distributed relatively homogeneously in a direction perpendicular to the backing, with the consequence that a comparatively high fraction is located in the vicinity of or even in direct contact with the abrasive grains. The bonding force between abrasive grains and size coat is lowered as a result. In contrast to this, grinding aid applied dry in the same amount is located on average at a greater distance from the abrasive grains, and so bonding between abrasive grains and size coat is affected less, or not all, as a result.

"Dry" in the context of the disclosure means that the grinding aid is not applied as a dispersed or suspended constituent of a liquid dispersion or suspension, respectively. Not excluded is the possibility of the grinding aid having, on its outer surface, liquid adhesions which may come about, for example, as a result of atmospheric moisture. Overall, however, in the context of the disclosure, any liquid fraction of the material applied in step b) ought to be less than 5% by weight and preferably less than 1% by weight. In many working examples, a liquid fraction at a low level of this kind allows the grinding aid to be free-flowing and hence easy to apply.

A "grinding aid" here and below means a substance which possesses at least one, preferably two or more, of the following properties: reduction of the temperature occurring on grinding, particularly on account of a lubricity effect; reduction of the temperature by melting and recrystallizing of the grinding aid; prevention of metal plating (so-called "glassing"); prevention of oxidation of the worked surface (oxides are frequently harder and hence more difficult to remove by working than metal); and/or prevention of conversion of the structure of the abrasive grains, for example from corundum to the more brittle spinel.

The grinding aid may be applied in step b), more particularly by scattering, in the form of a powder, in the form of flakes, in the form of fibres, in the form of agglomerates and/or in the form of capsules. An agglomerate here and below means an accumulation of hitherto loose individual particles to form a consolidated assembly. Consolidation may take place, for example, by means of an additional substance and, for instance, by pressing, hardening, drying and/or irradiating. In the case of a capsule, the grinding aid is surrounded by a shell, which may comprise or consist for example of waxes, fats and/or polymer solutions. The production of such capsules per se is known to the skilled person.

In addition to the grinding additive, the capsules may also comprise liquid constituents. Provided that these liquid constituents are surrounded with the shell, however, and are unable to emerge from it, these capsules are nevertheless considered in the context of the disclosure to be "dry" and scatterable.

Advantageously, at least a majority of the particles of the grinding aid have a size which is in the range from 0.1 μm to 2 mm, preferably from 0.1 μm to 0.5 mm, more preferably from 0.1 μm to 0.1 mm. Preferably at least 90% by weight, more preferably at least 95% by weight, very preferably at least 99% by weight of the particles, and especially preferably all of the particles, of the grinding aid ought to have a size within this range.

The $d_{s90}$ value of the size distribution of the particles of the grinding aid may lie in the range from 1 μm to 5 μm; the $d_{s50}$ value may lie in the range from 10 μm to 40 μm; the $d_{s10}$ value may lie in the range from 20 μm to 100 μm. Here, for example, a $d_{s90}$ value of 3 μm means that 90% by weight of the particles of the grinding aid have a size of 3 μm or more.

It is likewise useful if the average size of the particles of the grinding aid is lower than the average size of the abrasive grains. By this means, the particles of the grinding aid are able to span uniformly not only the surfaces of the abrasive grains but also the interstices between them. If the grinding aid is in the form of agglomerates or capsules, then the ratio of average diameter of the agglomerates to average diameter of the abrasive grains is preferably less than 5, more preferably less than 3 and more preferably still less than 2. The average diameter of the agglomerates is very preferably less than the average diameter of the abrasive grains. Likewise with preference, the size of the agglomerates is less than the $d_{s3}$ value of the abrasive grains.

The grinding aid can be applied at an application rate which lies in the range from 10 g/m$^2$ to 500 g/m$^2$, preferably from 20 g/m$^2$ to 400 g/m$^2$, more preferably from 25 g/m$^2$ to 250 g/m$^2$. When using potassium tetrafluoroborate as abrasive additive, application rates in the range from 30 g/m$^2$ to 35 g/m$^2$ have proved to be particularly advantageous for a grain size of #400, or in the range from 160 g/m$^2$ to 180 g/m$^2$ for a grain size of #36.

As already observed above, application rates of this kind, which are low in comparison to the prior art, are sufficient to obtain satisfactory total abrasion. More particularly, the above-stated application rates for potassium tetrafluoroborate correspond approximately to the application rates used in the case of a conventional, liquid coating with potassium tetrafluoroborate; the total abrasion amount, however, is significantly higher than in the case of the conventional, liquid coating.

In the method of the disclosure it is possible to use any substance as grinding aid that has also been employed in the liquid application methods customary to date. The grinding aid may comprise or consist for example of a salt, containing more particularly boron and/or fluorine, more particularly potassium tetrafluoroborate and/or cryolite.

Alternatively or additionally, the grinding aid may also comprise or consist of mica, sand, pigments, fumed silica, carbon, glass, talc, corundum and/or other minerals.

More particularly, the grinding aid may comprise or consist of at least one or more of the following substances:

$Al_2O_3$ (corundum, aluminium oxide)
$Al(OH)_3$ (aluminium hydroxide Hydral 710/PGA-SD)
$AlCl_3$ (aluminium chloride)
BN (boron nitride, hexagonal)
$BaBr_2$ (barium bromide)
$CaF_2$ (calcium fluoride, fluorspar)
$CaCl_2$ (calcium chloride)
$CaBr_2$ (calcium bromide)
C (graphite)
$C_{10}H_4Cl_4$ (tetrachloronaphthalene)
$C_7H_8Br_5$ (pentabromotoluene)
$C_9H_2Cl_6O_3$ (chlorendic anhydride)
$C_{12}H_{18}Br_6$ (hexabromocyclododecane)
$C_{12}H_{10}OBr_{10}$ (decabromodiphenyl oxide (flame retardant))
$C_{18}H_{12}Cl_{12}$ (Dechlorane A (flame retardant))
$CaCO_3$ (calcium carbonate)
$Ca_3(PO_4)_2$ (calcium phosphate)
$Ca(OH)_2$ (calcium hydroxide)
$(CH_2CHCl)_n$ (polyvinyl chloride, PVC)
$Cs_2SO_4$ (caesium sulphate)
$CuSO_4$ (copper sulphate)
$CoSO_4$ (cobalt sulphate)
$C_{20}H_{22}Cl_{20}$ (halogenated paraffins Chlorez 700, 760)
$FeS_2$ (iron(II) disulphide, pyrite)
$FeSO_4$ (iron sulphate)

$KBF_4$ (potassium fluoroborate)
$K_3AlF_6$ (potassium fluoroaluminate)
$K_2TiF_6$ (potassium fluorotitanate)
KCl (potassium chloride)
$K_4P_2O_7$ (potassium pyrophosphate)
$K_2SO_4$ (potassium sulphate)
$KNO_2$ (potassium nitrite)
$K_3PO_4$ (potassium phosphate)
$K_2HPO_4$ (potassium hydrogenphosphate)
$Li_2SO_4$. $H_2O$ (lithium sulphate)
MgF (magnesium fluoride)
$MoS_2$ (molybdenum(IV) sulphide)
$MoO_3$ (molybdenum(VI) oxide)
MnS (manganese(II) sulphide)
MgO (magnesium oxide)
$Mg(OH)_2$ (magnesium hydroxide)
$MgCO_3$ (magnesium carbonate)
$MgCO_3$ $Mg(OH)_2$ 3 $H_2O$ (nesquehonite)
MgO $CO_2$ $H_2O$ (magnesium carbonate subhydrate)
$MgSO_4$. 7 $H_2O$ (magnesium sulphate)
$MnSO_4$ (manganese sulphate)
$MgCl_2$ (magnesium chloride)
$MgBr_2$ (magnesium bromides)
$Na_3AlF_6$ (sodium fluoroaluminate, cryolite)
$NaBF_4$ (sodium fluoroborate)
$Na_2[B_4O_5(OH)_4]$.8 $H_2O$ (sodium borate, borax)
$(NH_4)_3AlF_6$ (ammonium fluoroaluminate)
NaCl (sodium chloride)
$Na_4P_2O_7$ 10 $H_2O$ (sodium pyrophosphate)
$Na_2SiO_3$ 9 $H_2O$ (sodium silicate)
$NH_4Cl$ (ammonium chloride)
$(NH_4)_2SO_4$ (ammonium sulphate)
$(NH_4)_3PO_4$ (ammonium phosphate)
$Na_2CO_3$ 10 $H_2O$ (sodium carbonate, crystal soda)
$Na_2SO_4$ 10 $H_2O$ (sodium sulphate, Glauber's salt)
$NaNO_2$ (sodium nitrite)
$Na_3PO_4$ (sodium phosphate)
$PbCl_2$ (lead(II) chloride)
Pb (lead)
$S_3Sb_2$ (antimony(III) sulphide)
$Sb_2O_3$ (antimony oxide)
Sn (tin)
Se . . . (selenides)
Te . . . (tellurides)
ZnS (zinc(II) sulphide)
$Zn_2P_2O_7$ (zinc pyrophosphate)
2 ZnO 3 $B_2O_3$ 3.5 $H_2O$ (zinc borate, Firebrake)
4ZnO $B_2O_3$ $H_2O$ (zinc borate, Firebrake 415)

The backing of the intermediate abrasive product may be any backing customary in the abrasives industry, more particularly a flexible backing, such as, for example, a textile backing, a paper, a film, vulcanized fibre or a combination thereof. The disclosure is likewise not confined to particular abrasive grains; the abrasive grain may be, for example, corundum (in a variety of forms, more particularly white corundum, semi-precious corundum, blue corundum, zircon corundum, ceramic corundum and/or brown corundum), silicon carbide, cubic boron nitride, diamond or mixtures thereof. The size of the abrasive grains is not essential either for the disclosure. The abrasive may be present in different made-up forms, for example as a grinding disc or grinding belt.

The abrasive grains may be bonded to the backing using a conventional make coat. Such a make coat may be, for instance, a conventional synthetic resin. A conventional binding agent may also be used as size coat, being composed likewise, for example, of synthetic resin. The size coat may, furthermore, comprise other typical active ingredients and/or fillers.

The size coat may be a phenolic resin, an epoxide, a urea resin, a melamine resin or an unsaturated polyester resin. With particular preference the size coat is a phenolic resin or an epoxide. The uncured size coat, to which the grinding aid is applied in step b), may have a viscosity of the kind customary for abrasives without a further layer of size coat (or "super size coat") and without grinding aid. The viscosity setting for a size coat is known to the skilled person.

Part of the size coat serves for the fixing of the grinding aid. This can be compensated by using a greater application rate of the size coat than usual and/or by the size coat having a higher resin content than usual. For example, the size coat can be applied at an application rate in the range from 40 $g/m^2$ to 700 $g/m^2$, preferably from 50 $g/m^2$ to 600 $g/m^2$, more preferably from 60 $g/m^2$ to 500 $g/m^2$. The solids content may be situated for instance in the range from 40% by weight to 95% by weight, preferably from 45% by weight to 93% by weight, more preferably from 50% by weight to 90% by weight. These application rates and this solids content may be dependent on the size of the abrasive grains. For example, in the case of a grade of P400, an application rate of 67 $g/m^2$ and a solids fraction may be suitable, whereas for a grade of P24 an application rate of 430 $g/m^2$ and a solids content of 88% may be more advantageous.

Another aspect of the disclosure is a coated abrasive which is obtainable by a method as described above. Accordingly, an abrasive of this kind comprises a backing, a multiplicity of abrasive grains, which are bonded to the backing, a size coat, which at least partly covers the abrasive grains, and also at least one grinding aid, which has been applied dry and is bonded by the size coat.

As already stated, the grinding aid is distributed more homogeneously parallel to the surface of the abrasive than in the case of conventional wet application.

Preferably at least 60% by weight, more preferably at least 80% by weight, very preferably at least 90% by weight of the particles of the grinding aid are disposed in an outer layer of the abrasive, the thickness of said outer layer being not more than 60%, preferably not more than 40%, more preferably not more than 30% of the overall thickness of the layer composed of size coat and grinding aids. In other words, therefore, a large part of the particles of the grinding aid are located in the vicinity of the surface of the layer of size coat.

Likewise preferably, the average application rate of the particles of the grinding aid above the abrasive grains differs from the average application rate of the particles of the grinding aid between the abrasive grains by less than 60%, preferably by less than 50%, more preferably by less than 40%. The application rate here again means the mass coverage per unit area, which can be expressed in $g/m^2$. Consequently the particles of the grinding aid are not particularly accumulated either between the abrasive grains or above the abrasive grains, and are therefore visibly more homogeneously distributed over the overall surface than with roll application. "Above the abrasive grains" means here that the particles of the grinding aid are disposed on the side of the abrasive grains that is remote from the backing.

The ratio of the layer thickness of the grinding aid above the abrasive grains to the layer thickness of the grinding aid between the abrasive grains is preferably at least 30%, more preferably at least 50%, very preferably at least 70%. A ratio of this kind means that a greater relative fraction of the grinding aid is located above the abrasive grains than is the case with conventional abrasives coated in liquid form. With the conventional mode of application, the layer thickness of the grinding aid on the peaks of the abrasive grains is very low, meaning that uncoated grain peaks are visible to the eye. The layer thickness can be determined by taking measurement from a photograph of a sectional view of the abrasive. This photograph may be taken through a microscope.

Lastly, the disclosure also relates to the use of an abrasive produced with the method described above for working a surface, more particularly a surface which comprises or consists of at least one metal, more particularly stainless steel, titanium and/or at least one so-called superalloy. The superalloys may be, for example, nickel-based alloys, cobalt alloys, nickel/iron alloys or hard bronzes. Superalloys of this kind are known for example under the trade names Inconel, Waspaloy or Rene.

BRIEF DESCRIPTION OF THE DRAWINGS

In the text below, the disclosure is elucidated using a number of working examples and drawings. In the drawings.

DETAILED DESCRIPTION

Figure 1A:
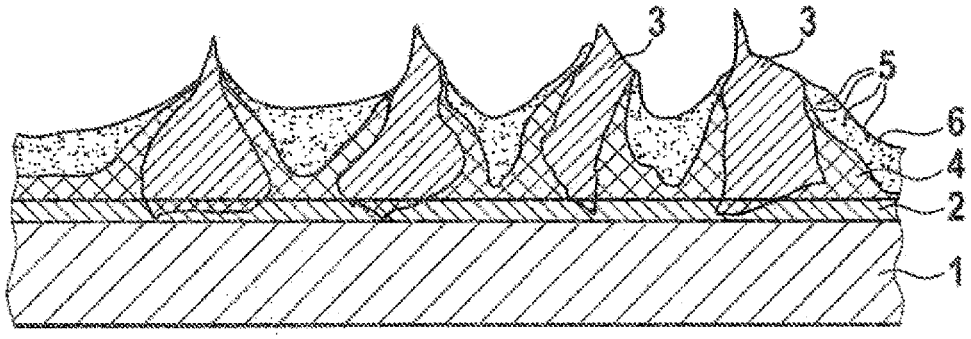
Fig. 1a PRIOR ART
FIG. 1*a* shows a schematic sectional view of a first known abrasive with wet-applied grinding aid before use.
Figure 1B:
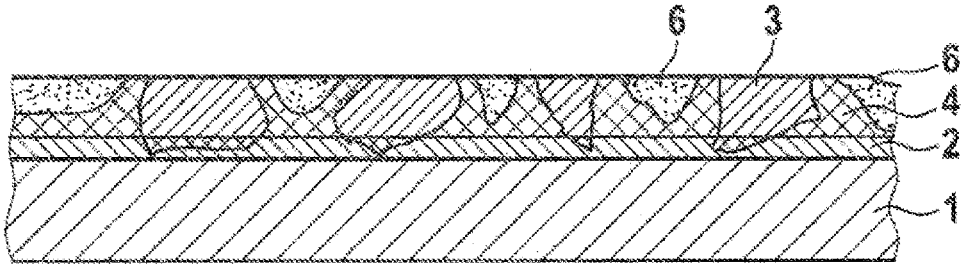
Fig. 1b PRIOR ART
FIG. 1*b* shows a schematic sectional view of the first known abrasive with wet-applied grinding aid after use.

The conventional coated abrasive shown schematically in FIG. 1*a* comprises a backing 1, abrasive grains 3, which are bonded by means of a make coat 2 to the backing 1, and also a size coat 4, which covers the abrasive grains 3. With the aid of a known roll process, a liquid additional coating 6 has been applied with the aid of rolls, and comprises a multiplicity of particles 5 of a grinding aid. As a result of the rolling, the particles 5 have been accumulated substantially between the individual abrasive grains 3. In this way, when a surface is being worked, a large part of the particles 5 do not come into contact at all with this surface. After use of the abrasive 1, a part of the abrasive grains 3 has been abraded, as evident in FIG. 1*b*. Up to this point in time, however, numerous particles 5 of the grinding aid have remained unused, and this is extremely inefficient economically.

Figure 2A:
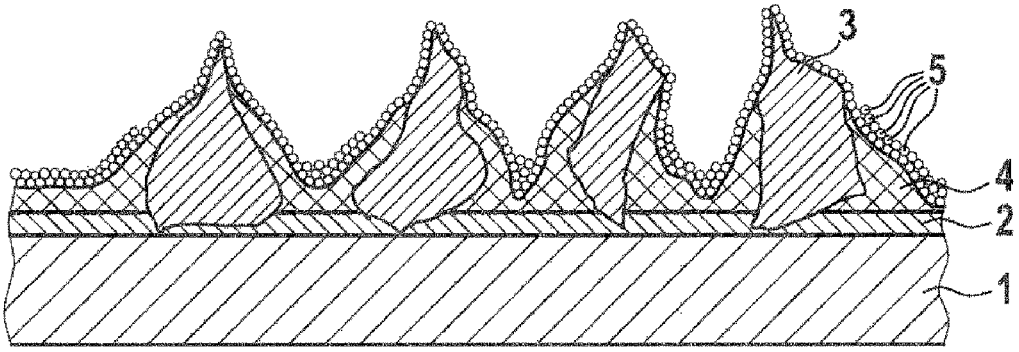
FIG. 2*a* shows a schematic sectional view of a first abrasive according to the disclosure, with dry-applied grinding aid before use.
Figure 2B:
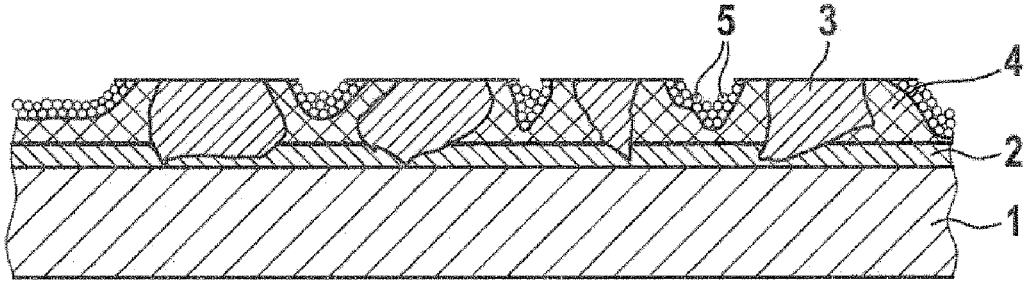
FIG. 2*b* shows a schematic sectional view of the first abrasive according to the disclosure, with dry-applied grinding aid after use.

In contrast to this, FIG. 2*a* shows abrasive according to the disclosure, in which the grinding aid has been applied dry as elucidated in more detail below. Here, the particles 5 of the grinding aid are disposed in the vicinity of the outer surface of the size coat 4. Moreover, they are distributed more homogeneously over this surface and are not accumulated in the regions between the abrasive grains 3. In this way, a larger fraction of the particles 5 of the grinding aid comes into contact with a surface to be worked, and is able there to develop its desired effect. This larger fraction has been abraded in the used state of the abrasive 1, which is shown in FIG. 2*b*.

For the production of coated abrasives, first of all a multiplicity of intermediate abrasive products was provided. These intermediate products contained a backing 1 of vulcanized fibre with a thickness of 0.8 mm. Using a make coat 2, abrasive grains 3 composed of two different corundums with sizes of #36 and #50 were bound to the backing 1 at a rate of 800 g/m$^2$ (grain size #36) and 570 g/m$^2$ (grain size #50). The make coat 2, comprising phenolic resin and chalk, was applied at a rate of 178 g/m$^2$ (grain size #36) and 175 g/m$^2$ (grain size #50). Subsequently an uncured and therefore still liquid size coat 4 comprising phenolic resin/chalk was applied at a wet rate of 650 g/m$^2$ (grain size #36) and 450 g/m$^2$ (grain size #50).

Potassium tetrafluoroborate ($KBF_4$) was applied as grinding aid to the thus-produced intermediate abrasive product, in Examples 1 to 7 as per Table 1 and in Examples 8 to 11 as per Table 2.

Figure 3:
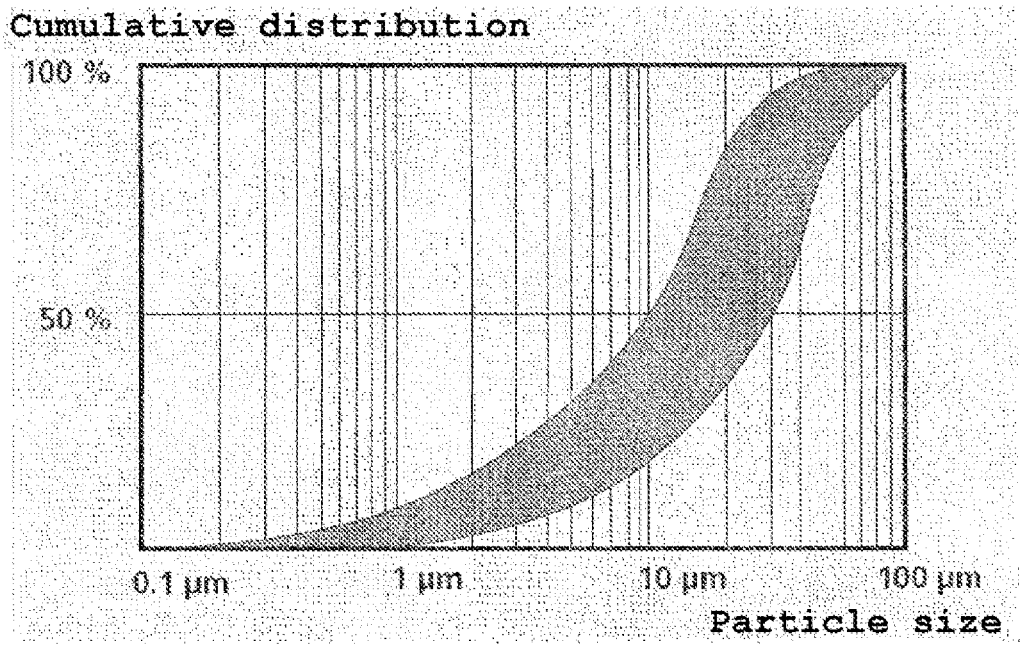
FIG. 3 shows a size distribution of particles of a grinding aid.

The potassium tetrafluoroborate powder was obtained from Solvay Fluor GmbH, 30173 Hanover, Germany. The size distribution of the powder particles is indicated by the cumulative distribution in FIG. 3.

In Comparative Examples 1, 9 and 11, the grinding aid was applied in the form of a liquid additional coating. This liquid additional coating had the following composition:

| | |
|---|---|
| Phenolic resin 75% | 12% by weight |
| $KBF_4$ | 50% by weight |
| Cryolite | 10% by weight |
| Water | 17% by weight |
| Colorant, wetting agent, $TiO_2$, plasticizer, thickener | 11% by weight |

For producing the disclosed Examples 2 to 8 and 10, powder-form potassium tetrafluoroborate ($KBF_4$) was applied in dry form to the still-uncured size coat. The potassium tetrafluoroborate was applied uniformly to the intermediate abrasive product by means of a conventional application station for powder-form media. The application rates are shown in Tables 1 and 2.

In all of the examples (both as dry powder in the disclosed examples and as dispersed particles in the comparative examples), the potassium tetrafluoroborate particles had an average size of 25 μm in each case.

For the abrasives of Examples 1 to 7, Table 1 records the total abrasion achievable with these abrasives with abrasive grains of grain size #36. This total abrasion was determined by punching the cured abrasive to form abrasive discs having a diameter of 180 mm. The abrasive discs were affixed to a grinding machine, operated at a cutting speed of 33.6 m/s, and pressed down with a force of 50 N perpendicularly in succession onto a multiplicity of adjacently disposed plates, 4 mm thick, made of stainless steel (X5CrNi18-10 1.4301). The rate of tangential advance was 1.5 m/min, with grinding taking place with a contact roll. The amount of material abraded was determined individually for each plate by differential measurement. Working was continued until the abrasion amount per plate had dropped to around 35% of the abrasion amount for the first plate. Table 1 reports the total abrasion hereby obtained, and the loss of covering, i.e. the mass of the original abrasive disc that was abraded therefrom in the course of working.

As is evident from Table 1, the amount of grinding aid needed in the case of the disclosed dry application (Example No. 3) relative to the customary wet application (Example No. 1) is only around half in order to achieve approximately the same total abrasion.

TABLE 1

| | Example No. | | | | | | |
|---|---|---|---|---|---|---|---|
| | 1 | 2 | 3 | 4 | 5 | 6 | 7 |
| Application mode | wet (comparative example, average values from 8 samples) | dry | dry | dry | dry | dry | dry |
| $KBF_4$ application rate [g/m$^2$] | 172 (contained in 344 g/m$^2$ wet-applied additional coating) | 43 | 87 | 112 | 152 | 178 | 208 |
| Total abrasion [g] | 159 | 119 | 160 | 180 | 192 | 216 | 220 |
| Covering loss [g] | 3.5 | 2.9 | 3.0 | 3.1 | 3.4 | 3.4 | 4.0 |

Figure 4:
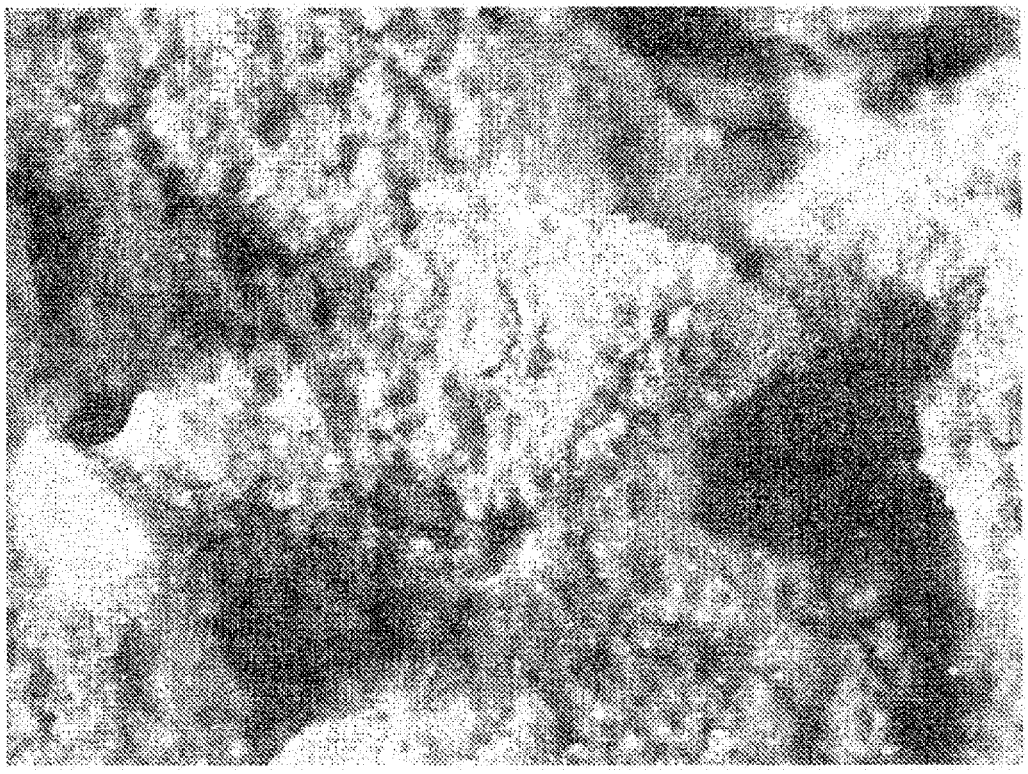
FIG. 4 shows a photograph of a plan view of a second abrasive according to the disclosure, with abrasive grains of size #36 and $KBF_4$ as grinding aid, which has been applied dry at an application rate of 178 g/m$^2$.
Figure 5:
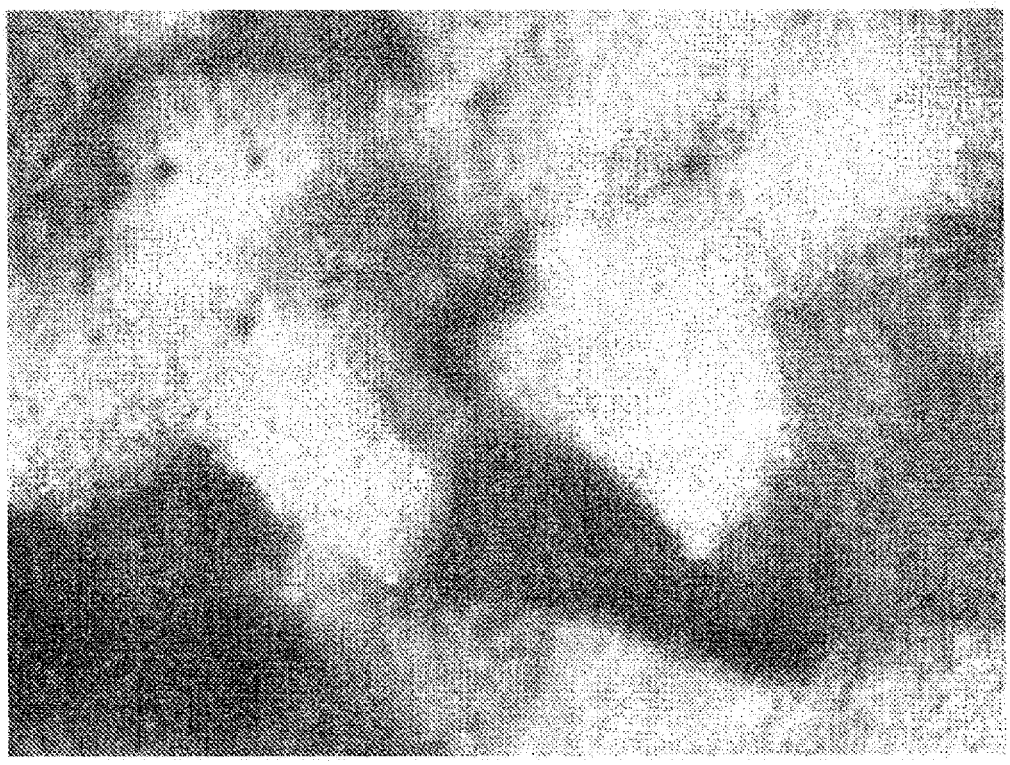
FIG. 5 shows a photograph of a plan view of a second comparative example of an abrasive with abrasive grains of size #36 and $KBF_4$ as grinding aid, which has been applied in liquid form by roll application.
Figure 6:
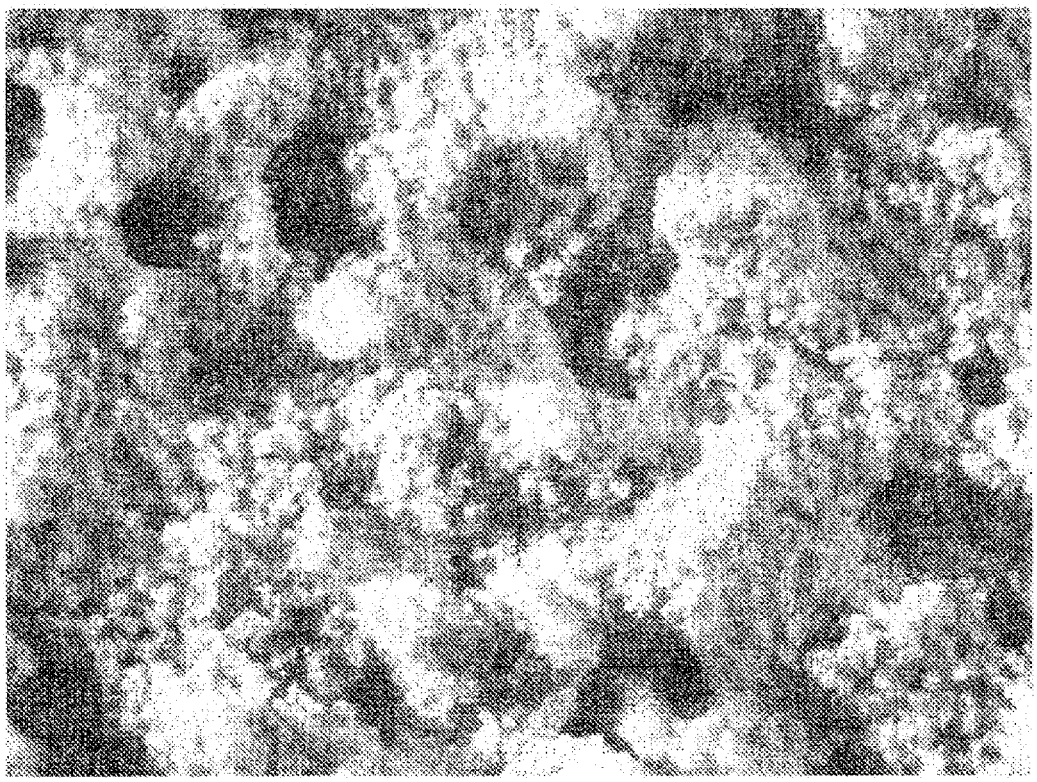
FIG. 6 shows a photograph of a plan view of a third abrasive according to the disclosure, with abrasive grains of size #50 and grinding aid which has been applied dry.
Figure 7:
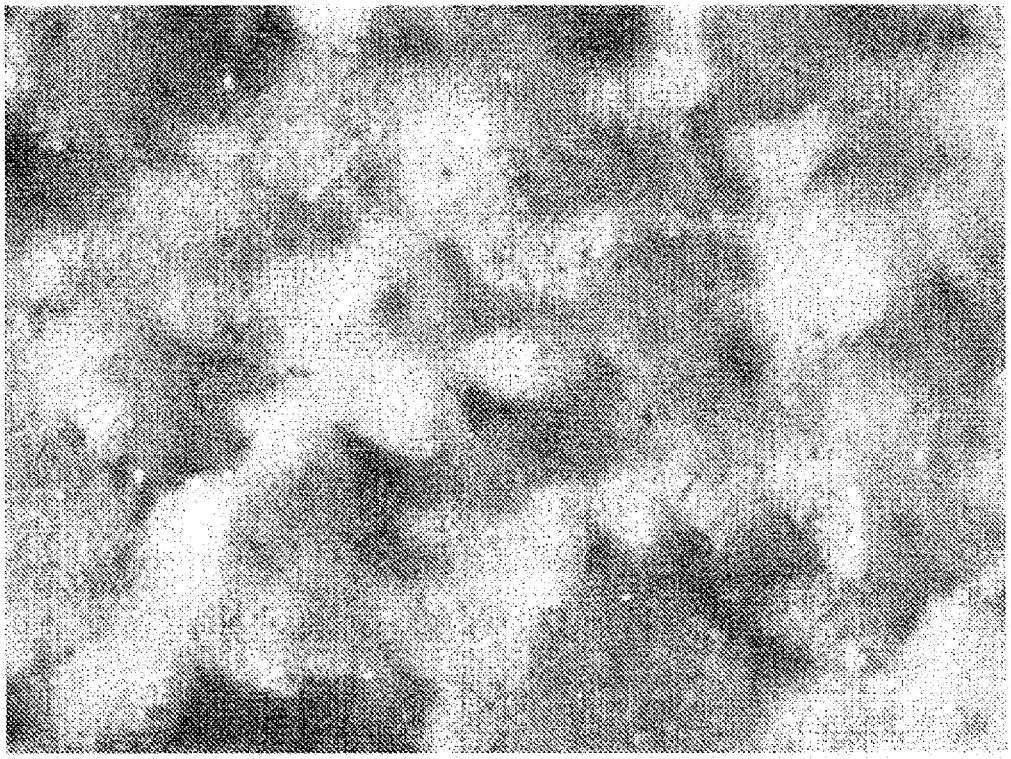
FIG. 7 shows a photograph of a plan view of a third comparative example of an abrasive with abrasive grains of size #50 and grinding aid which has been applied in liquid form by roll application.

FIGS. 4 to 7 contain photographs of plan views of the coated abrasives 8 to 11 as per Table 2. FIGS. 4 and 5 therefore show abrasives with a grain size of #36, with FIG. 4 showing a grinding disc with grinding aid applied dry in accordance with the disclosure, and FIG. 5 showing an abrasive with wet-applied grinding aid. FIGS. 6 and 7 show abrasives with a grain size of #50.

As is apparent from comparing the figures, the particles of the grinding aid in accordance with the disclosed dry application (FIGS. 4 and 6) are present on the surface of the abrasive, and in particular also above the individual abrasive grains. Moreover, the particles of the grinding aid are distributed substantially homogeneously over the surface. In the case of the comparative examples with wet application (FIGS. 5 and 7), in contrast, the particles of the grinding aid have penetrated further between the abrasive grains and are therefore virtually no longer visible.

TABLE 2

| | Example No. | | | |
|---|---|---|---|---|
| | 8 | 9 | 10 | 11 |
| FIG. No. | 4 | 5 | 6 | 7 |
| Grain size | # 36 | # 36 | # 50 | # 50 |
| Application mode | dry | wet (comparative example) | dry | wet (comparative example) |

TABLE 2-continued

| | Example No. | | | |
|---|---|---|---|---|
| | 8 | 9 | 10 | 11 |
| $KBF_4$ application rate [g/m$^2$] | 178 | 172 (contained in 344 g/m$^2$ wet-applied additional coating) | 136 | 138 (contained in 276 g/m$^2$ wet- applied additional coating) |

Figure 8:
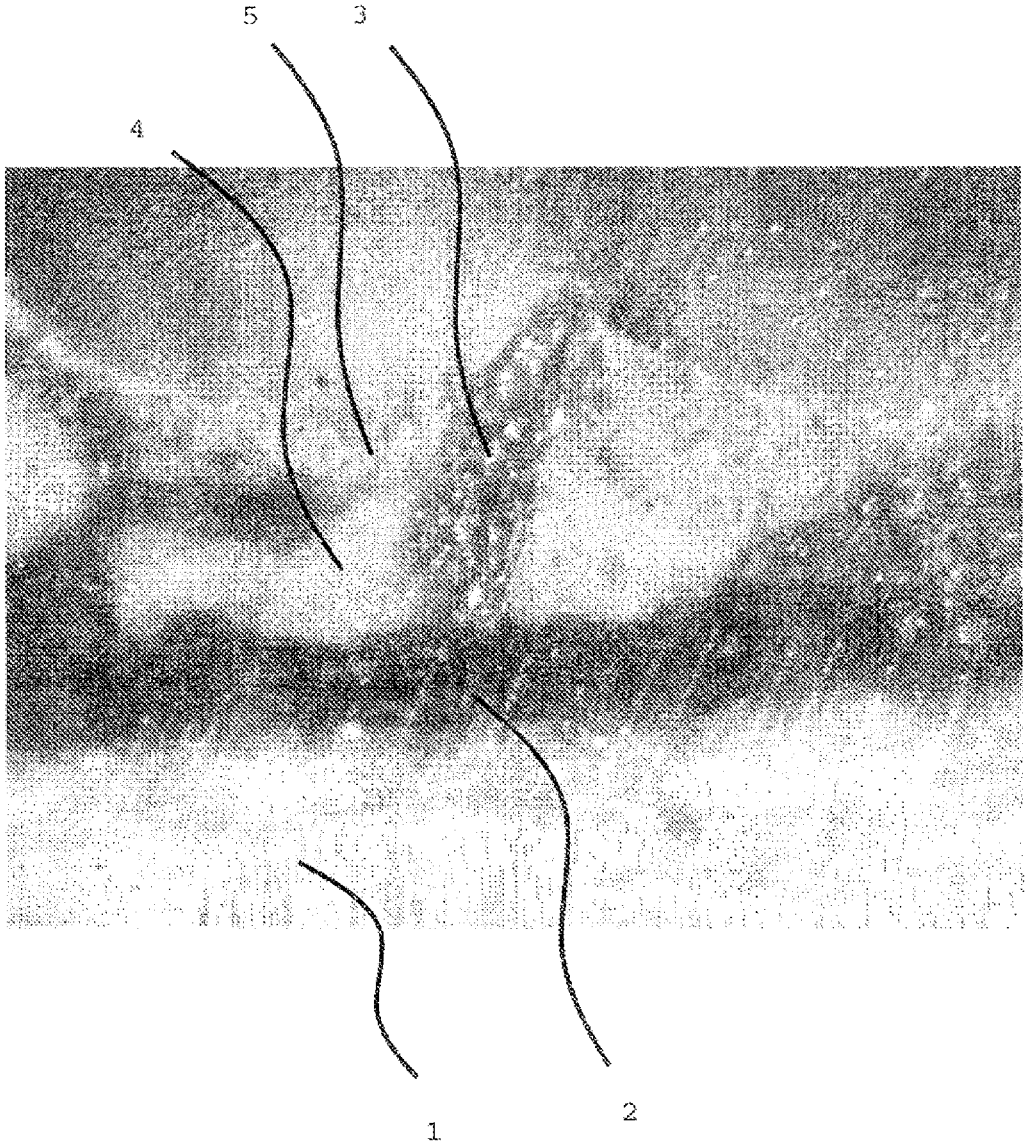
FIG. 8 shows a photograph of a sectional view of a fourth comparative example.

FIG. 8 shows a photograph of a sectional view through a conventional abrasive, in which the grinding aid 5 is embedded in a liquid-applied additional coating 6. As can clearly be seen here, a large part of the grinding aid is located in the regions between the abrasive grains 3, where, however, it is completely unable to develop its intended effect.

Figure 9:
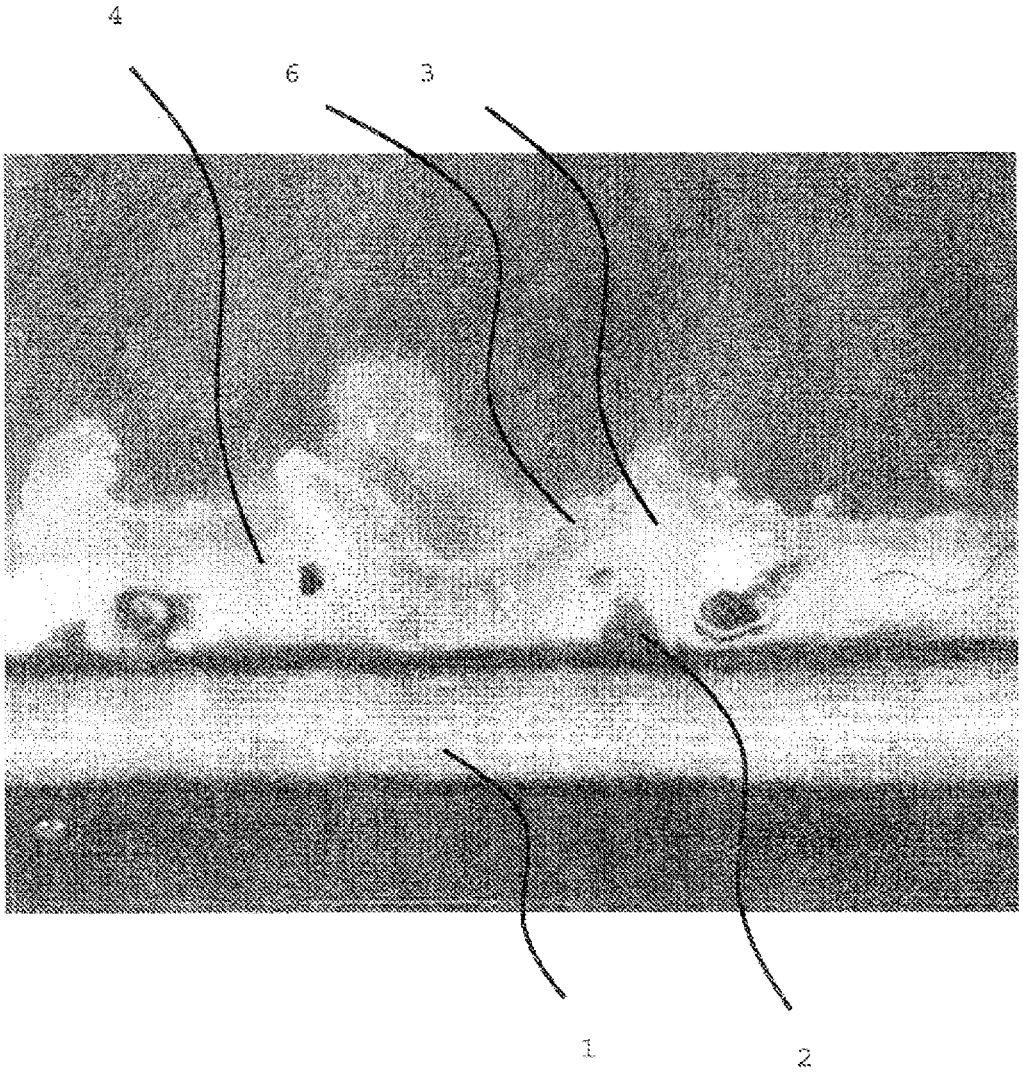
FIG. 9 shows a photograph of a sectional view of a fourth abrasive according to the disclosure.

FIG. 9 shows a photograph of a sectional view through a further abrasive according to the disclosure. The abrasive grains 3 are bonded by means of a make coat 2 to a backing 1 composed of vulcanized fibre with a thickness of 0.8 mm. Backing 1, make coat 2 and abrasive grains 3 are covered by a layer of size coat 4. Located above this layer is a further layer of dry-applied grinding aid 5. As is also apparent from this figure, the layer of grinding aid 5 has a substantially homogeneous thickness. Moreover, it can be seen that the grinding aid 5 has virtually not penetrated into the layer of size coat 4. Furthermore, the particles of the grinding aid 5 are bonded directly by the size coat 4. There is therefore no need for further binding agent, of the kind necessary in the case of conventional, wet application of the additional coating.

Figure 10:
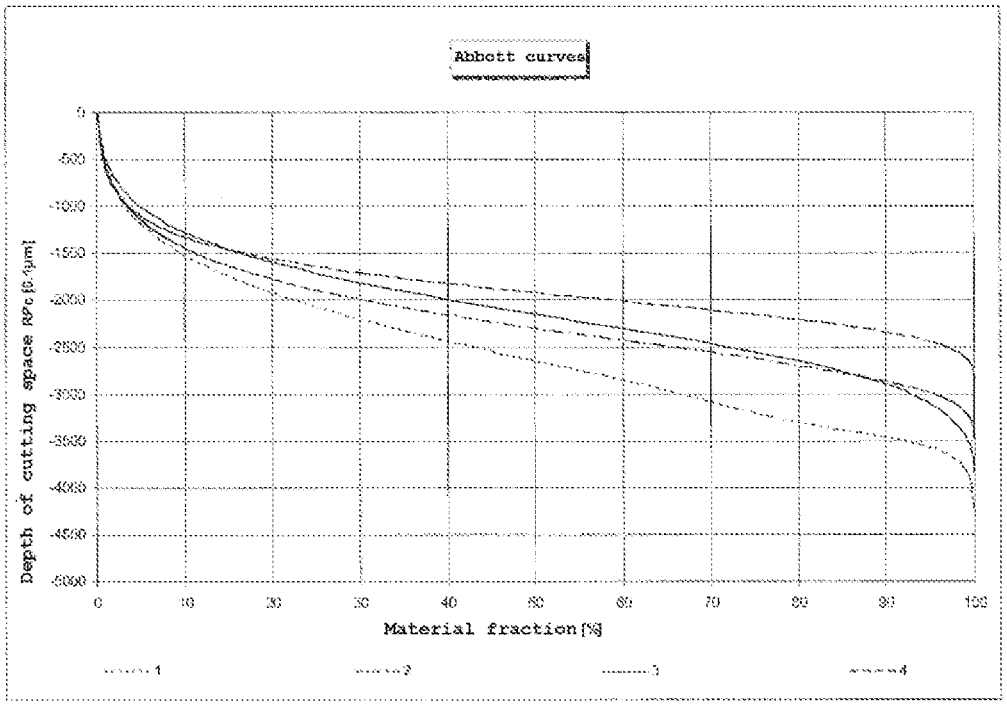
FIG. 10 shows Abbott curves of a number of abrasives.

FIG. 10 shows Abbott curves for a number of abrasives, these curves having been determined in accordance with DIN EN ISO 4287. The first curve (1) was measured on a backing on which an abrasive grain mixture comprising corundum had been bonded. This mixture contained semi-precious corundum of grade P120 and ceramic corundum of grade #120. This backing had a difference in height of 436 μm. The difference in height, here and below, refers to the difference in the heights of a point on the surface that is furthest removed from the backing, and a point on the surface that is situated closest to the backing; the difference in height, therefore, is equal to the difference of the ordinate values of the Abbott curve at 0% and at 100%.

Following application of a size coat, the second curve (2) was obtained, with a difference in height of 368 μm. The third curve (3) was determined for an abrasive according to the disclosure in which potassium tetrafluoroborate ($KBF_4$) with an average grain size of 25 μm was applied dry at a rate of about 64 g/m$^2$; the difference in height here is 386 μm. In comparison to this, the fourth curve (4) shows the result for a conventional abrasive in which the potassium tetrafluoroborate was applied in a dispersion; the resulting difference in height was 288 μm. The dispersion was applied at a rate of 120 g/m$^2$, giving an application rate of 54 g/m$^2$ of the potassium tetrafluoroborate.

As can be seen from FIG. 10, the third curve (3) of the abrasive according to the disclosure, with fractions of material of less than about 15%, lies above the fourth curve (4) of the conventional abrasive, while with higher fractions of material the third curve lies below the fourth. The reason for this is that in the case of dry application, a relatively large number of the particles of the grinding aid are located in the region of the highest elevations (in other words, in the region of a depth of cutting space of 0 μm). In the case of wet application, in accordance with curve (3), a larger portion of the grinding aid has dropped into the region between abrasive grains, meaning that, here, the fraction of material is greater in the case of greater depths of cutting space. Moreover, the difference in height of curve (3) for the disclosed abrasive is greater than the difference in height of the curve (4) for the conventional abrasive. The reason for this as well is that a large fraction of the particles of the grinding aid is located in the region of the highest elevations.

The invention claimed is:

1. A coated abrasive comprising:

a backing;

a multiplicity of abrasive grains bonded to the backing;

a size coat that at least partly covers the abrasive grains; and at least one grinding aid including a plurality of grinding aid particles bonded to an uppermost layer of the size coat, wherein an average size of the grinding aid particles is lower than an average size of the abrasive grains, and wherein the at least one grinding aid includes a first portion of the grinding aid particles above the abrasive grains and a second portion of the grinding aid particles between the abrasive grains, and an areal density of the first portion of the grinding aid particles above the abrasive grains differs from an areal density of the second portion of the grinding aid particles between the abrasive grains by less than 60%.

2. The coated abrasive according to claim 1, wherein the at least one grinding aid includes a first portion of grinding aid above the abrasive grains and a second portion of grinding aid between the abrasive grains, and a ratio of a layer thickness of the first portion of the grinding aid above the abrasive grains to a layer thickness of the second portion of the grinding aid between the abrasive grains is at least 30%.

3. The coated abrasive according to claim 1, wherein the grinding aid particles are applied in a generally homogeneous layer that includes the first portion above the abrasive grains and the second portion between the abrasive grains.

4. The coated abrasive according to claim 1, wherein the grinding aid particles are applied in a homogeneous layer that includes the first portion above the abrasive grains and the second portion between the abrasive grains.

5. A coated abrasive comprising:

a backing;

a multiplicity of abrasive grains bonded to the backing;

a size coat that at least partly covers the abrasive grains; and at least one grinding aid including a plurality of grinding aid particles bonded to an uppermost layer of the size coat, wherein an average size of the grinding aid particles is lower than an average size of the abrasive grains, and wherein at least 60% by weight of the grinding aid particles are disposed in an outer layer of the coated abrasive, a thickness of said outer layer being not more than 60% of a combined overall thickness of the uppermost layer of the size coat and the at least one grinding aid.

6. A coated abrasive comprising:

a backing;

a multiplicity of abrasive grains bonded to the backing;

a size coat that at least partly covers the abrasive grains; and at least one grinding aid including a plurality of grinding aid particles bonded to an uppermost layer of the size coat, wherein at least 95% by weight of the grinding aid particles have a size in a range from 0.1 μm to 0.1 mm, and wherein at least 60% by weight of the grinding aid particles are disposed in an outer layer of the coated abrasive, a thickness of said outer layer being not more than 60% of a combined overall thickness of the uppermost layer of the size coat and the at least one grinding aid.

7. The coated abrasive according to claim 6, wherein the at least one grinding aid includes a first portion of grinding aid above the abrasive grains and a second portion of grinding aid between the abrasive grains, and a ratio of a layer thickness of the grinding aid above the abrasive grains to a layer thickness of the grinding aid between the abrasive grains is at least 30%.

8. The coated abrasive according to claim 7, wherein the ratio of the layer thickness of the first portion of the grinding aid above the abrasive grains to the layer thickness of the second portion of the grinding aid between the abrasive grains is at least 50%.

9. The coated abrasive according to claim 7, wherein the ratio of the layer thickness of the first portion of the grinding aid above the abrasive grains to the layer thickness of the second portion of the grinding aid between the abrasive grains is at least 70%.

10. The coated abrasive according to claim 6, wherein the at least one grinding aid includes a first portion of the grinding aid particles above the abrasive grains and a second portion of grinding aid particles between the abrasive grains, and an areal density of the first portion of the grinding aid particles above the abrasive grains differs from an areal density of the second portion of the grinding aid particles between the abrasive grains by less than 60%.

11. The coated abrasive according to claim 10, wherein the areal density of the first portion of the grinding aid particles above the abrasive grains differs from the areal density of the second portion of the grinding aid particles between the abrasive grains by less than 40%.

12. The coated abrasive according to claim 6, wherein the coated abrasive is configured for working a surface which comprises one or more of stainless steel, titanium, and at least one superalloy.

13. The coated abrasive according to claim 6, wherein at least 90% by weight of the particles of the grinding aid are disposed in the outer layer of the abrasive, the thickness of said outer layer being not more than 30% of the combined overall thickness of the uppermost layer of the size coat and the grinding aid.

* * * * *